United States Patent [19]

Frambach

[11] 4,132,035

[45] Jan. 2, 1979

[54] INSULATED WINDOW ASSEMBLY

[75] Inventor: Henry R. Frambach, Allendale, N.J.

[73] Assignee: Samson Industries, Inc., Glen Cove, N.Y.

[21] Appl. No.: 850,942

[22] Filed: Nov. 14, 1977

[51] Int. Cl.[2] ..... E06B 7/16

[52] U.S. Cl. ..... 49/484; 49/62; 49/381

[58] Field of Search ..... 49/484, 381, 62

[56] References Cited

U.S. PATENT DOCUMENTS

| | | | |
|---|---|---|---|
| 2,568,130 | 9/1951 | Olson | 49/62 |
| 3,229,332 | 1/1966 | Koller | 49/483 X |
| 3,308,582 | 3/1967 | Bakke | 49/484 X |

FOREIGN PATENT DOCUMENTS

| | | | |
|---|---|---|---|
| 230964 | 10/1960 | Australia | 49/484 |

*Primary Examiner*—Philip C. Kannan

*Attorney, Agent, or Firm*—Mark T. Basseches; Paula T. Basseches

[57] ABSTRACT

The present invention is directed to an insulated window assembly including a fixed frame adapted to be installed in a building structure and a movable, pane carrying operating sash mounted on the fixed frame. The invention is characterized by the provision of a novel seal structure defined between the fixed frame and outer pane member, said seal being formed laterally interiorly of the glazed connection between the pane and sash whereby leakage between the fixed and moving frames is effectively blocked, the seal also protecting the said glazed connection. Where used in conjunction with a metal framed window device, the assembly provides protection against heat loss comparable to that provided by conventional thermal break windows, without the attendant disadvantages thereof.

4 Claims, 4 Drawing Figures

FIG. 1
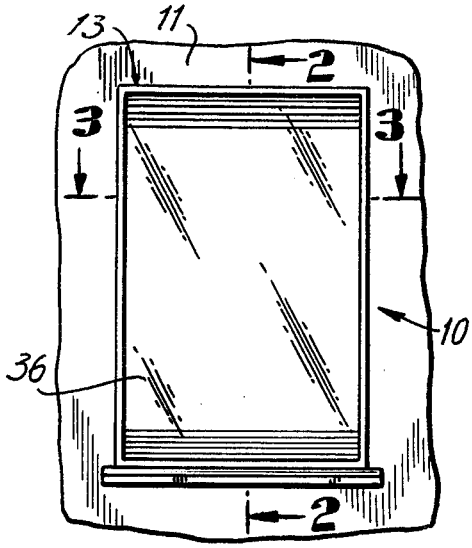
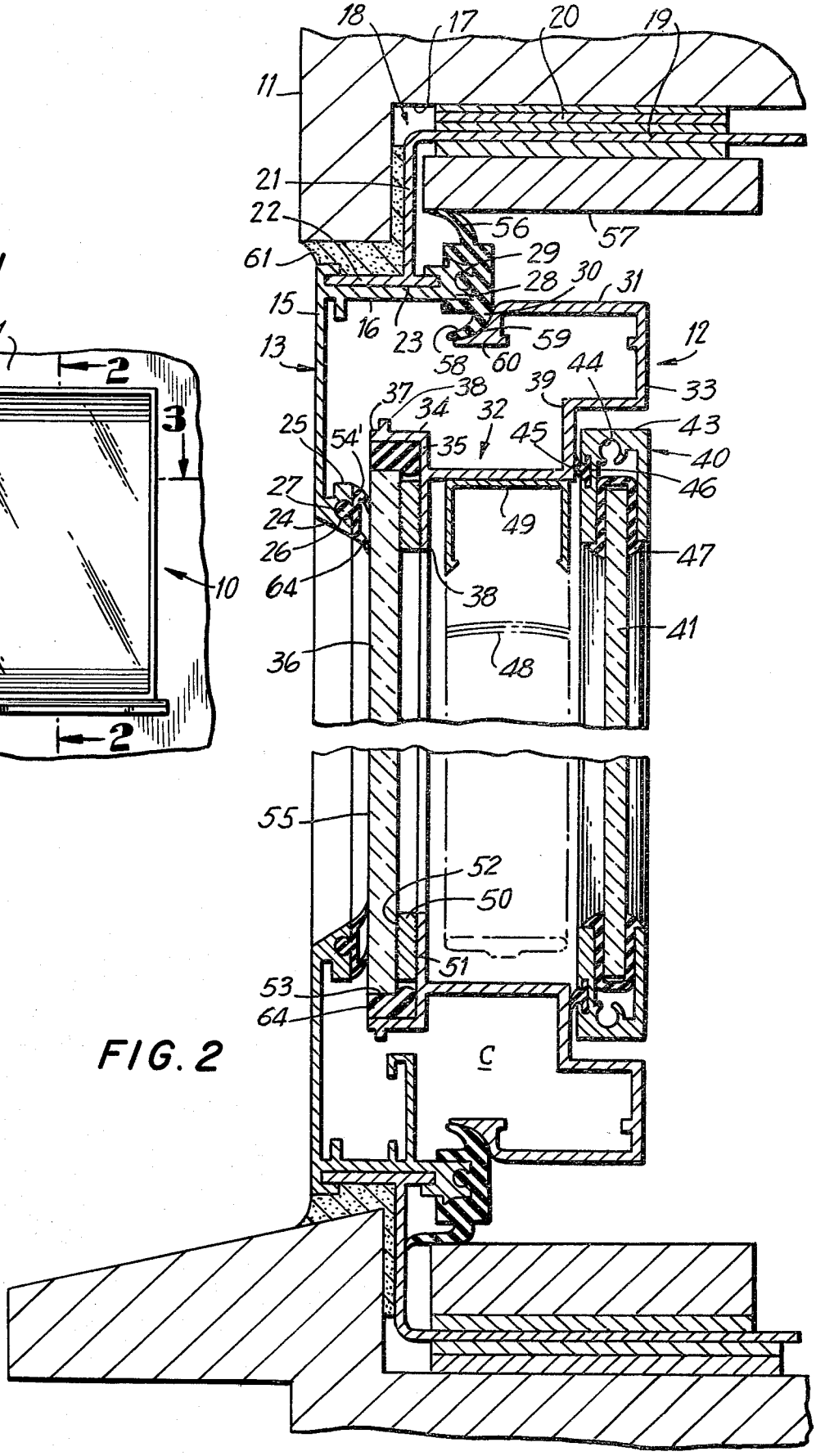
FIG. 2

INSULATED WINDOW ASSEMBLY

BACKGROUND OF THE INVENTION

1. Field of the Invention

The present invention is in the field of window structures and is directed more particularly to a simple economical window which is highly resistant to the ingress of moisture, dirt or drafts, has a high degree of protection against heat loss, and presents, at the same time, a narrow sight line.

2. The Prior Art

Numerous attempts have been made to construct window assemblies including operating sash components which, without undue complexity, provide a high degree of isolation of the interior from the exterior in the closed condition of the window.

In the typical window construction, a first seal is effected between the window frame and the frame of the operating sash. A second seal is defined between the glass lites or panels themselves and the operating sash, it being apparent that leakage of either of such seals will compromise the integrity of the barrier defined by the window construction.

In order to optimize the barrier effectiveness defined by the window, various weather-stripping arrangements between the frame and the operating sash have been proposed. To prevent leakage between the glass panels or lites and the operating sash, a multiplicity of glazing systems have been suggested.

In window devices of the type described, particularly those which are double glazed to minimize heat loss through the window panels, it has been proposed, where the frame material is made of metal, to form both the operating sash and the fixed frame of two discrete metal frames linked or connected by thermal insulating material, such windows being known as "thermal break" windows. The interposition of the insulating material which eliminates metal-to-metal contact between the frames interrupts the heat path from the interior to the exterior, reducing heat loss. Thermal break windows give rise to additional problems, however, in that stock material from which frames are made are relatively expensive to manufacture, and by virtue of the interposed plastic between the stock material components, lacks the rigidity of a unitary metal frame. The resultant loss of rigidity prevents the frame, and particularly the operating sash, from structurally reinforcing the glass lites against flexture where, by virtue of relative movement between the lites and the operating sash, the glazed connection is compromised, with attendant undesirable effects.

Thermal break windows, as well as virtually all other windows, by reason of the necessity for providing two laterally displaced seal areas about the perimeter (the division line between the fixed and the operating sash on the one hand, and the glazed connection between the glass lites and the operating sash on the other) present an aesthetically undesirable appearance, resulting from the presence of multiple breaks of the seal lines. Moreover, since the glazing or gasketting whereby the outer glass pane is mounted in its frame is, in conventional windows, exposed directly to the elements, the glazing tends, in time, to harden and crack, with resultant leaks and other structural defects.

SUMMARY

The present invention may be summarized as directed to an improved window assembly including a fixed frame within which is mounted a movable operating sash or frame, the combination including seal means interposed between the fixed frame and the glass lite carried by the operating sash, which seal means provides a weather-tight connection between the noted parts, whereby it simultaneously isolates and protects the secondary seal defined by the glazed connection between the lite and the operating sash from exposure to the elements.

The invention is further directed to a window of the type described which eliminates the necessity for providing a conventional thermal break construction wherein the operating sash and the fixed frame are fabricated of two separate frames structurally interconnected by a thermal insulating member, the device nonetheless being characterized by a heat loss factor equivalent to that of a conventional thermal break window.

The device, in its preferred form, includes a fixed outer frame adapted to be mounted within a building opening, the fixed frame carrying an operating sash or movable frame within which is mounted a pair of glass lites or panels, the lites or panels including the usual glazed connection to the frame.

The device is characterized by the provision of a first perimetric seal carried by the fixed frame and positioned to form a seal with the outermost lite of glass at a position laterally inwardly spaced with respect to the glazed connection between the movable frame and the lite.

A second perimetric seal is defined between the fixed and moving frames at a position remote from the first seal and preferably at a position adjacent the interior portion of the frames, the seals and frames together defining, in the closed condition of the window, an essentially sealed circumferential chamber surrounding the movable frame, and encompassing the glazing structures thereof. Since all portions of the movable frame are isolated from exposure to the exterior, the heat loss factor is reduced to a value comparable to the so-called thermal break windows without the high cost and structural weakness factors ordinarily associated with such windows.

By defining the outer seal at a position laterally inwardly of the glazed connection between the movable frame and the outer lite of glass, such glazed connection is isolated from the exterior environment and thus protected against compromise resulting from exposure to the elements.

Since the outer frame overlaps the glass carried by the operating sash or movable frame, the window assembly provides, from the exterior, an essentially unbroken appearance, there being but a single junction line appearing between the glass and the frame rather than the double line inherent in window structures heretofore known, i.e. the glazing line and the space between the frame and operating sash.

The device of the present invention has the further substantial advantage of permitting an effective and efficient seal between the outermost frame and the outermost glass lite, without the necessity for maintaining close tolerances in the fabrication of the window, thereby reducing production costs and minimizing the possibility that improper installation of the windows in the field will compromise the effectiveness of the barrier provided by the window.

Since the outermost seal in the device of the instant invention is defined against a flat glass plate, the weather-tightness of the seal is assured. In contrast, in conventional windows wherein the seal is effected between a weatherstrip member extending toward and engaging a frame member or a weatherstrip member carried by the frame member, it will be readily apparent that the effectiveness of the seal is dependent upon the accuracy with which the seal engaging portions of the frame have been formed, and any warping or distortion of the frame opening or any malformation of the mitred corners of the frame engaged by the seal will compromise the effectiveness thereof.

A further advantage of the instant invention is that the operating sash frame need not include a leg or flange overlying the front or outermost face of the outermost glass lite, as is mandated in conventional operating window constructions. The elimination of the flange is feasible in view of the fact that the seal formation carried by the stationary frame performs, in essence, the function of the said flange. More specifically, when the operating sash of a conventional window is moved outwardly to the closed position, the inertia of the glass when the window comes to a sudden stop is absorbed by the facing flange overlapping the margin of the outer glass lite, and in the absence of such flange, the glazed connection would rapidly be compromised. In applicant's device the inertia absorbing function is performed by the seal carried by the frame, permitting elimination of the flange, with consequent saving of aluminum or other frame material. By eliminating the front flange of the operating sash frame, the process of removal of glazing material and/or reglazing are greatly simplified since glazing may be removed from the front of the window. Reglazing of conventional window designs requires disassembly of the operating sash frame.

Accordingly, it is an object of the invention to provide an improved insulated window construction.

A further object of the invention is the provision of an insulated window construction of the type described wherein the frame defines a first perimetric seal with the outermost glass lite whereby the glazed connection between the outermost lite and the operating sash or movable frame is protected from exposure to the elements.

A further object of the invention is the provision of an insulated window construction of the type described which results in a low heat loss factor comparable to thermal break windows heretofore known, without the added expense and loss of rigidity and structural integrity normally associated with thermal break windows.

A still further object of the invention is the provision of a window of the type described which is inexpensive to manufacture, involves low maintenance and preserves the integrity of the glazing system, and particularly the glazing system employed to support the outer lite or pane.

A further object of the invention is the provision of a window of the type described which presents a narrow and unbroken sight line to the exterior, with consequent improved aesthetic appearance.

To attain these objects and such further objects as may appear herein or be hereinafter pointed out, reference is made to the accompanying drawings, forming a part hereof, in which:

FIG. 1 is a front elevational view of a window assembly of the type described;

FIG. 2 is a magnified vertical section taken on the line 2—2 of FIG. 1;

Figure 3:
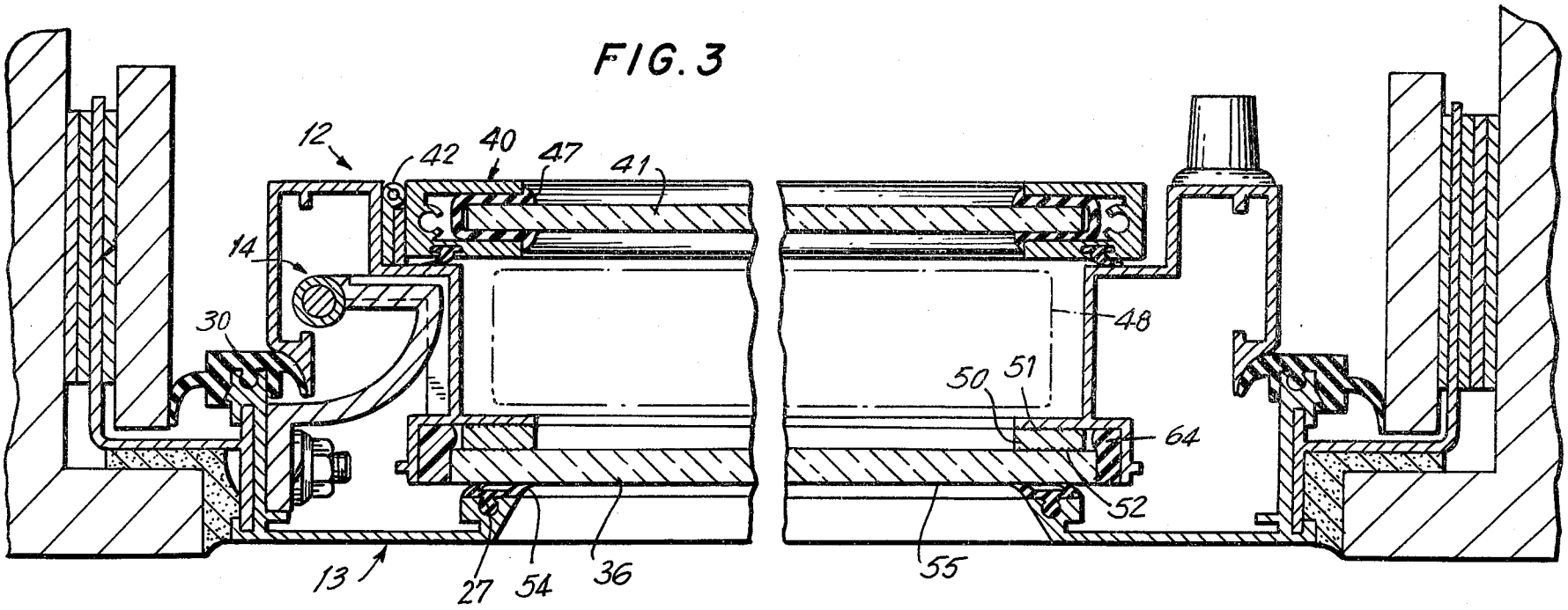
FIG. 3 is a magnified horizontal section taken on the line 3—3 of FIG. 1.

Turning now to the drawings, the window assembly 10 is shown in FIG. 1 installed in a wall 11 of a building. The specific details of construction whereby the parts may be fixed to the building may vary from case to case. Generally, the window device includes an inner or sash carrying frame assembly 12 and an outer fixed frame assembly 13, the sash assembly 12 being mounted for pivotal inward movement relative to the frame assembly 13, as by hinge assembly 14 (see FIG. 3).

The outer of fixed frame assembly 13, which is preferably formed of four lengths of extruded aluminum joined at their corners, is generally L-shaped in section, including a front or outer leg 15 and an inwardly extending leg 16. The frame member may be physically attached to the building opening 17 by angle bars 18, the angle bars 18 including inwardly directed shank 19 secured by any suitable means to parallel structural components 20 defining the window opening.

The angle bars include a laterally inwardly directed leg portion 21 having an integral transverse web 22 sized to fit within outwardly facing complemental dovetail slot 23 formed in the leg 16 of the outer frame assembly 13.

The outer leg 15 defines, in essence, a flange which carries at its distal end 24 an enlarged receiver portion 25 having formed therein a non-reentrant gasket support slot 26, within which slot may be mounted the outer perimetric gasket 27.

The inner distal end 28 of the leg 16 of the outer frame includes a similar non-reentrant slot 29 for supporting a second or inner perimetric gasket member 30.

The inner frame 12 is essentially U-shaped in transverse section and includes an upper leg portion 31, a longer lower leg portion 32 and a connecting web 33. The lower leg portion 32 includes at its outer distal end 34 a right angle formation 35 defining a ledge for seating and mounting the outer lite 36. More particularly, the angle formation 35 includes an outwardly facing leg 37 and a laterally directed leg 38. The inner sash, which is preferably likewise formed of an integral aluminum extrusion may include a stop flange 39, against which a vent frame member 40 carrying inner glass lite 41 may seat.

The vent frame 40, which optionally but preferably is hinged to the sash assembly 12 by hinge 42, comprises a U-shaped extrusion 43 having an internal screwway 44, facilitating fastening of the four sections defining the frame at their corners. The vent frame 40 may include conventional gasketting 45, supported in an outwardly facing groove 46, whereby a seal is defined between the vent frame and the stop flange 39 of the sash frame 12.

The inner lite 41 is mounted by conventional neoprene or like gasketting 47 within the vent frame 40. The space between the lites 36 and 41 may be employed to contain a Venetian blind assembly 48 supported within blind mounting channel 49, as is known.

The outer lite 36 is mounted within the inner frame 12 so as to define a tight seal, protecting the interior against leakage of water, detritus and the like. Numerous glazing means may be employed for mounting the lite 36 in the desired manner. In the illustrated embodiment, the outer lite 36 is mounted by using a continuous gasketting strip 50, the outer faces 51 and 52 of which are coated with an adhesive, the lite 36 being laid in position while the frame is horizontally disposed and maintained in the desired orientation by the adhesive. Thereafter, a waterproof sealing material, such as a liquid silicone material 64, may be flowed into the continuous groove defined between the outermost edge 53 of the glass lite and the inwardly facing surface of the leg 37, the material, after hardening, forming a dependable and preferably hermetically sealed connection between adjacent parts.

Importantly, the glazing of the outermost lite may be effected through the use of materials especially adapted to the formation of a tight seal, without regard to the ability of such materials to resist such deteriorating influences as actinic rays, etc. since the glazed connection is not exposed to the exterior.

Referring now to details of the sealing arrangement whereby the improved results hereinabove referred to are achieved, first gasket member 27 mounted in flange 24 includes one or more inwardly directed, resiliently deflectible ribs or lips 54, 54', which, in the illustrated embodiment, bear against the outer face 55 of the outer lite 36 at a position just inwardly of the glazing connection effected between the outer lite and the inner sash frame.

It is thus seen that there is defined a continuous perimetric seal area between the gasket 27 and the said outermost face 55 of the lite 36. The inner perimetric gasket 30 shields the inwardly facing portions of the outer frame.

The gasket 30 includes an outwardly directed lateral leg portion 56 which is resiliently and yieldingly biased against laterally inwardly facing surface 57 defining a portion of the window opening.

The gasket 30 includes an inwardly directed resilient deflectible lip 58 which bears, in the closed position of the window, against a complementally configurated arcuate surface 59 of the distal portion 60 of the end of the leg 31 of the inner frame assembly.

It will thus be apparent that in the closed position of the window illustrated in FIG. 2, there is defined between the inner and outer frame assemblies 12, 13 a sealed interior chamber C, the chamber being bounded by the inner frame assembly 12, the outer frame assembly 13, a first perimetric seal portion effected by the gasket 27 and a second perimetric seal area defined between the lip 58 of the gasket 30 and the opposed surface 59 at distal end of leg 31. All inwardly facing portions of the outer frame not embedded in masonry, etc., are covered by insulating gasket material.

It will further be observed that since the seal formed by the gasket 27 is effected at a position laterally inwardly of the glazing area connecting the outer lite 36 to the inner sash assembly, all metallic portions of the said inner sash assembly are isolated from exposure to the exterior of the building and shielded from the elements. It will also be appreciated that the glazed connection between the outer lite 36 and the inner sash assembly is likewise shielded from the elements by virtue of the inwardly disposed location of the continuous perimetric seal provided by the gasket 27.

In order to assure a weatherproof connection between the outer frame assembly 13 and the building wall 11, a waterproofing compound 61 may be forced into the area between the noted parts after installation of the window.

It will be noted that the sight line provided by the described assembly is a relatively narrow one, being defined by the width of the forwardly facing leg 15 of the outer frame assembly, and that the said sight line is uninterrupted.

The window assembly described is relatively inexpensive to fabricate, providing essentially the insulating efficiency of a thermal break window without the attendant cost and structural weakness disadvantages associated with thermal breaks. Moreover, whereas thermally broken windows expose the glazed connection between the outermost lite and the inner removable sash to the outside, risking compromise of such connection, the device of the present invention isolates the glazing from the elements.

Figure 4:
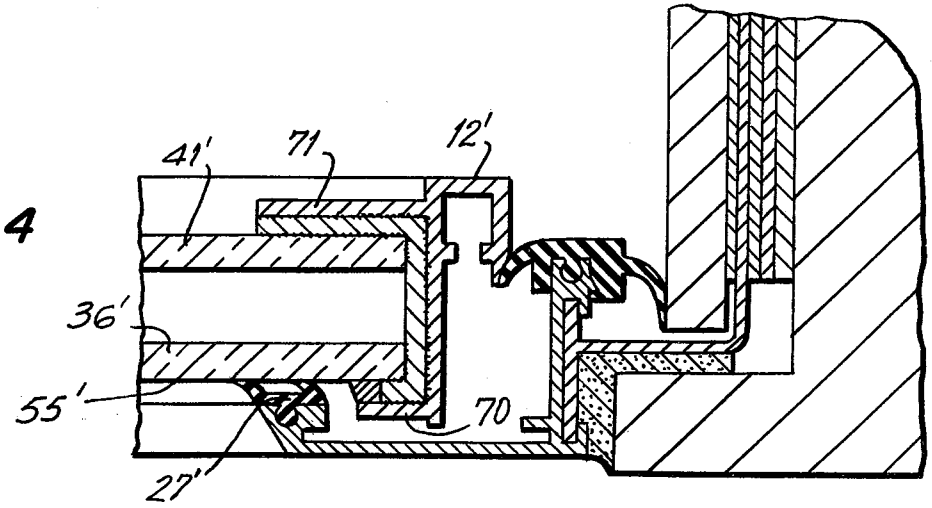
FIG. 4 is a fragmentary horizontal section of an embodiment of the invention.

The embodiment illustrated in FIG. 4 operates on essentially the same principles as the embodiment previously described but is of simplified construction, the outer and inner lites 36' and 41' being conventionally glazed within the partial box formation defined between legs 70 and 71 of the inner sash assembly 12'. It will be observed that the perimetric seal defined between the gasket 27' and the outer face 55' of lite 36' functions in the same manner as previously described, i.e. to isolate the glazed connection and the entirety of the metallic components of the inner sash assembly from exposure to the outside.

It will be recognized that, unlike the previously described embodiment wherein the inner lite 41 was pivotally mounted to the inner sash assembly, the two lites 36' and 41' of the embodiment of FIG. 4 are maintained as a unit.

The auxiliary glazing protection effected by the gasket 27' is of particular importance where used in conjunction with an assembly as shown in FIG. 4 wherein the two lites are permanently glazed into position and access is not afforded to the space between the lites since, in devices of this type, any compromise of the glazing will result in admission of moisture to such interior space and the forming of a clouding film of moisture which can be removed only by disassembly of, or replacement of, the glass.

It will be recognized that skilled workers in the art may, in the light of the instant disclosure, make changes and/or modifications in the specific embodiments illustrated without departing from the spirit of the invention. Accordingly, the invention is to be broadly construed within the scope of the appended claims.

Having thus described the invention and illustrated its use, what is claimed as new and is desired to be secured by Letters Patent is:

1. A window construction for installation in the window receiving opening of a building comprising, in combination an outer fixed frame member, means mounting said fixed frame member in said opening, an inwardly extending leg portion on said fixed frame member, and a sash frame member having a leg portion movably mounted to said fixed frame member, said sash frame member carrying an inner and outer glass lite, glazing means interposed between and connecting said sash frame member and the periphery of said lites defining a sealed connection between said lites and said sash frame member, a continuous laterally inwardly extending flange formed on said outer fixed frame member overlapping the outermost face of said lites adjacent the periphery thereof, a first resilient, deflectible, continuous perimetric gasket member carried by said flange portion and forming, in the closed position of said window, a continuous seal area with the outer face of said outer lite in laterally inwardly spaced relation to said glazing means, a second resilient, deflectible, continuous perimetric gasket member interposed between said frame members abutting said inwardly extending leg portion on said fixed frame member and a portion of said building opening and abutting said sash frame leg portion in closed position to define a continuous seal area therebetween in spaced relation to said first seal area, whereby there is defined in the area bounded by said frames and gaskets a substantially sealed surrounding chamber, said glazing means being shielded against exposure to the exterior environment by said first resilient deflectible continuous perimetric gasket in the closed position of said window.

2. A window construction in accordance with claim 1 wherein said frames are metallic.

3. A window construction in accordance with claim 1 wherein all inwardly facing portions of said fixed frame member external of said chamber are encompassed within said second gasket member.

4. A device in accordance with claim 1 wherein the edges of said outer glass lite are spaced laterally inwardly of all portions of said glazing pocket.

* * * * *